US006266855B1

(12) United States Patent
Specht et al.

(10) Patent No.: US 6,266,855 B1
(45) Date of Patent: Jul. 31, 2001

(54) SEAT BELT BUCKLE

(75) Inventors: Martin Specht, Feldafing; Walter Krauss, München; Stephan Schwald, Seefeld; Thomas Schrott, Feldafing, all of (DE)

(73) Assignee: Breed Automotive Technology, Inc., Lakeland, FL (US)

( * ) Notice: Subject to any disclaimer, the term of this patent is extended or adjusted under 35 U.S.C. 154(b) by 0 days.

(21) Appl. No.: 09/440,752

(22) Filed: Nov. 16, 1999

(30) Foreign Application Priority Data

Feb. 4, 1999 (DE) ..... 199 04 567

(51) Int. Cl.[7] ..... A44B 11/25

(52) U.S. Cl. ..... 24/633; 24/637; 24/641; 24/642

(58) Field of Search ..... 24/633, 637, 641, 24/642, 644, 651

(56) References Cited

U.S. PATENT DOCUMENTS

| | | | | |
|---|---|---|---|---|
| 4,550,474 | * | 11/1985 | Doty et al. | 24/637 |
| 4,597,141 | * | 7/1986 | Wier | 24/633 |
| 5,008,989 | * | 4/1991 | Wedler et al. | 24/641 |
| 5,704,099 | * | 1/1998 | Cahill | 24/633 |
| 5,784,766 | * | 7/1998 | Downie et al. | 24/641 |

FOREIGN PATENT DOCUMENTS

| | | |
|---|---|---|
| 19545899 | 6/1997 | (DE) . |
| 0212507 | 8/1986 | (EP) . |
| 0485656 | 11/1990 | (EP) . |
| 0777984 | 12/1996 | (EP) . |
| 2151691 | 7/1985 | (GB) . |
| 2173243 | 10/1986 | (GB) . |
| 2271378 | 4/1994 | (GB) . |
| WO8103603 | 12/1981 | (WO) . |

* cited by examiner

*Primary Examiner*—Victor N. Sakran
(74) *Attorney, Agent, or Firm*—Lonnie Drayer

(57) ABSTRACT

A seat belt buckle has a guide channel formed in a buckle frame into which a tongue connected to a seat belt can be inserted. An ejector, located in the guide channel acts, as an ejector spring in the ejection direction opposite to the insertion direction of the tongue. A locking element is mounted on the buckle frame and can be moved out of an unlocking position into a locking position in order to lock the tongue in the guide channel. A securing element is movable between a securing position for holding the locking element in the locking position and a release position for releasing the locking element. A blocking device is mounted on the securing element and is moved into a blocking position when the locking element is in the locking position. The securing element is held in the securing position against a movement into the release position, whereby the blocking device is held in the blocking position by the ejector.

16 Claims, 3 Drawing Sheets

SEAT BELT BUCKLE

FIELD OF THE INVENTION

This invention relates to a buckle for a seat belt.

DISCUSSION OF THE PRIOR ART

The buckle taught by DE 195 45 has a guide channel inside a buckle frame, into which a tongue connected to a seat belt can be inserted. An ejector is guided in the guide channel, upon which ejector is acting an ejector spring in the ejection direction, opposite to the insertion direction. Furthermore, a locking element is moveably mounted on the buckle frame. The locking element can be moved into a locking position for locking the tongue introduced into the guide channel and into a release position for releasing the tongue. A securing element is moveably mounted on the buckle frame, which securing element can be moved into a securing position for holding the locking element in its locking position and into a release position for releasing the locking element. Furthermore, a support is provided, which holds the securing element in the securing position upon excessive acceleration and/or deceleration. This ensures that the securing element remains in its securing position, even during high acceleration and/or deceleration of the buckle, such as, for example, upon retensioning of the buckle via a belt tightener acting upon the buckle. The locking element is thereby secured in its locking position, so that the desired tightening of the belt, which is held in the buckle, is obtained.

As a result of its inertia and the inertia of the support, the securing element is held in the securing position in the acceleration phase of the retensioning procedure. Upon deceleration, a compensating mass, which is linearly guided in the guide channel on the buckle frame, acts upon the securing element through a lever arm and the support, holding the securing element in the securing position. The ejector is supported through the ejector spring on the compensating mass. An actuating lever, which is formed as an angle lever, is pivotably mounted on the securing element, such that the insertion movement of the tongue can be transmitted through the actuating lever onto the locking element in order to ensure its movement into the locking position.

In the seat belt buckle known from EP 0 212 507, a compensating mass mounted on a lever arm acts through a support (plunger) upon the securing element in the acceleration phase of the retensioning procedure. In the deceleration phase, however, the effect of the lever on which the compensating mass is mounted, is cancelled due to the inertia of the compensating mass which tends to continue its movement in the direction of the acceleration phase of the retensioning procedure, such that an absolutely secure holding of the securing element in the securing position by means of the compensating mass is no longer ensured.

SUMMARY OF THE INVENTION

The seat belt buckle of the present invention has a blocking device mounted on, or connected, to a securing element, which blocking device may be designed as an angle lever, as known from EP 0 777 984 A2. The blocking device is moved into a blocking position when the locking element is in the locking position. The securing element is thus held in its securing position, against a movement in the release position. The blocking device is thereby held in the blocking position by the ejector. When the blocking device is designed as an angle lever, it has two functions. Upon introduction of the buckle tongue, the blocking device in the same manner as the actuating lever known from EP 0 777 984 A2, is rotated by the ejector mass, such that the locking element is pushed into its final locking position. The other function consists in holding the blocking device in its blocking position by the ejector. The securing element is thereby held against movement in the release position. The locking element is thus secured in its locking position.

The blocking device is located in its blocking position, upon acceleration of the buckle, for example upon a retensioning procedure, as well as upon deceleration of this accelerated movement. Likewise, in those embodiments in which, upon deceleration, the ejector, as a result of its inertia, performs a movement against the force of an ejector spring inside the guide channel, the invention ensures that the blocking device is held in its blocking position.

This may be achieved by appropriately designing the blocking device contour on the ejector. The longitudinal extension of the blocking device contour is dimensioned such that the blocking device remains engaged with the blocking device contour throughout the movement of the ejector from its normal position in the locking position to a rear abutment position, and is thus held in the blocking position.

When the blocking device is designed as an angle lever, one of the two lever arms may engage the ejector, especially the blocking device contour on the ejector. The other lever arm may be held in abutment with a buckle part, preferably with the locking element in its locking position, such as to prevent a movement into the release position. The blocking device is held in this blocking position between this abutment and the ejector, especially the blocking device contour on the ejector. Since the blocking device is mounted on the securing element or connected thereto, the securing element, which may be designed as a peg in a known manner, is held in its securing position.

A deformable part may be provided on the ejector. When the buckle movement which was accelerated in the insertion direction is then decelerated, in particular the retensioning movement, the deformable part acts as an energy absorbing means upon impact of the ejector, as a result of its inertia, on a frame-fixed abutment, which delimits the backward movement of the ejector. Bounce movements of the other buckle components, which may occur as a result of the hard impact of the ejector, are thus prevented.

The securing element may be spring biased. To this effect, a spring may be provided, which is linearly guided and supported on the buckle frame. The spring bias is directed such that in the locking position the securing element is pressed against an abutment on the buckle frame. When the locking element is in its unlocking position, the securing element is pressed against a holding surface on the locking element, whereby the locking element is held in its unlocked position inside the buckle frame.

The invention provides an impact-resistant seat belt buckle, comprising fewer components. A secured locking of the locking element, engaging the tongue, is ensured upon excessive acceleration, as for example upon retensioning of the buckle, as well as jerky deceleration at the end of the retensioning movement.

BRIEF DESCRIPTION OF THE DRAWINGS

Embodiments of the invention will be described in detail with reference to the figures, in which.

DETAILED DESCRIPTION OF THE INVENTION

Figure 1:
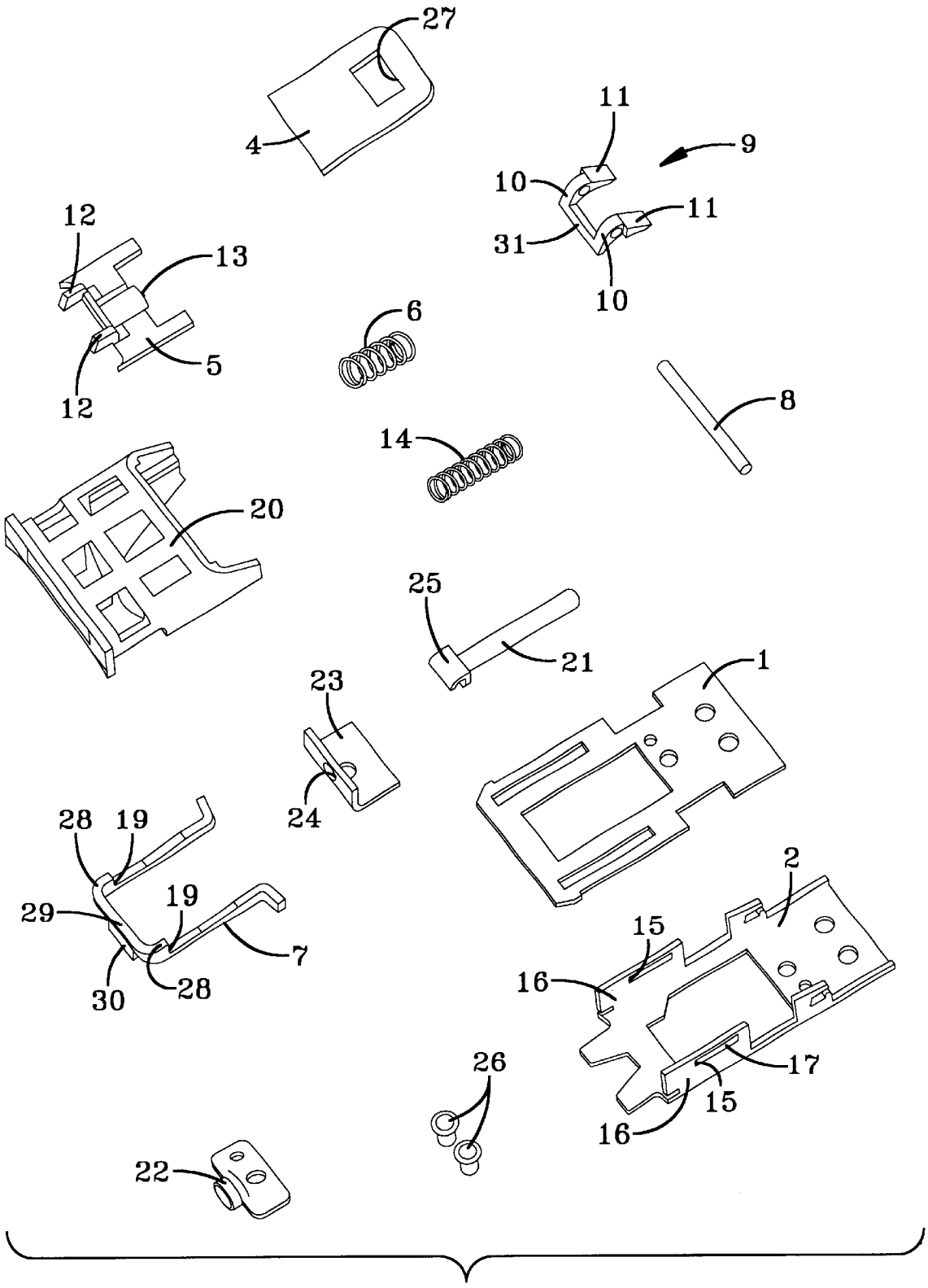
FIG. 1 is an exploded view of the individual buckle components.
Figure 2:
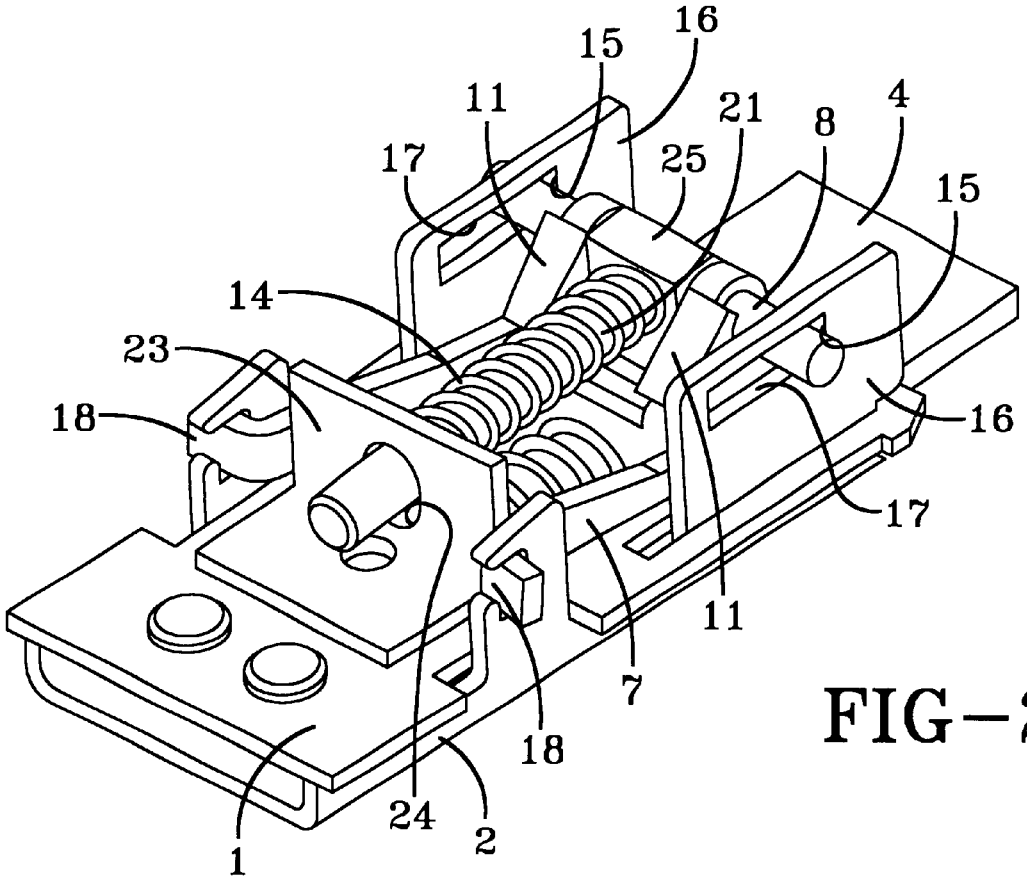
FIG. 2 is an oblique top perspective view of the rear side of the buckle.
Figure 3:
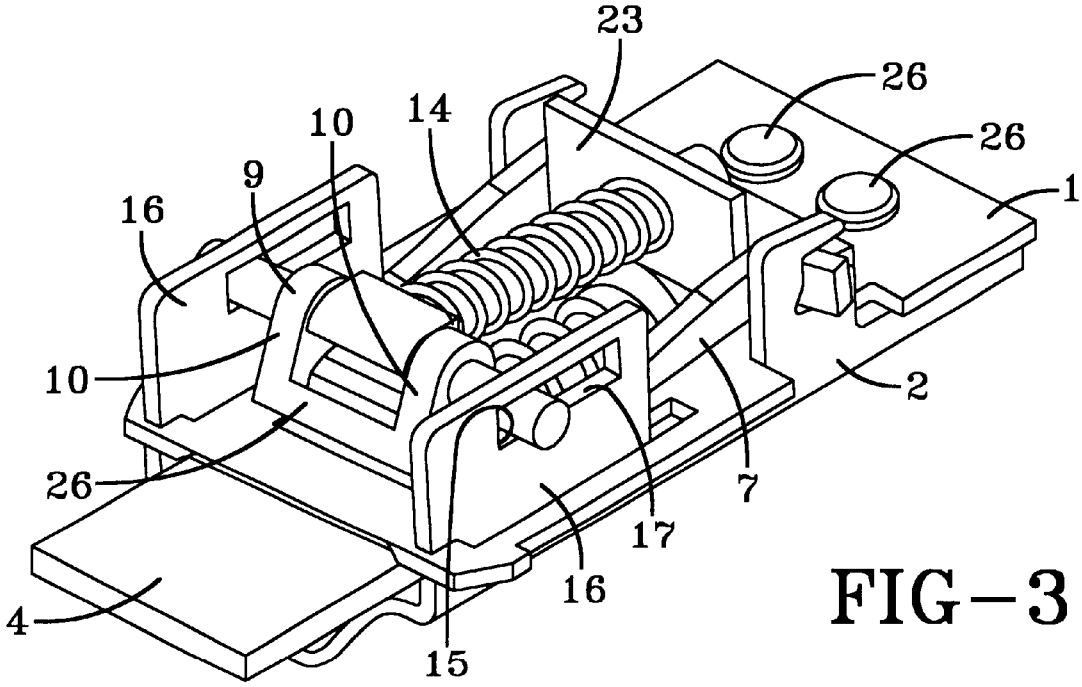
FIG. 3 is an oblique top perspective view of the front side.

In the illustrated embodiment of a seat belt buckle, a buckle frame is substantially formed by an upper plate 1 and a lower plate 2. The two plates are interconnected via connecting bolt 26. A guide channel 3 is formed between the upper plate and the lower plate. An ejector 5 is guided in the guide channel 3 such as to be longitudinally movable. The ejector is biased in the ejection direction of a tongue 4, by an ejector spring 6, which is supported on an abutment 22 defined on the buckle frame. The tongue is connected to a seat belt (not shown) in a known manner.

Figure 4:
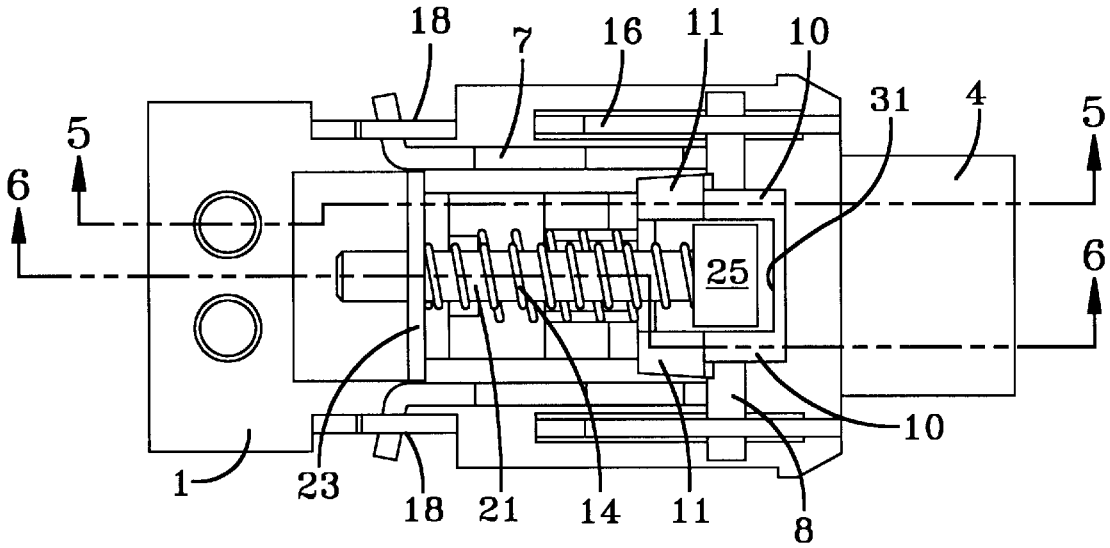
FIG. 4 is a top view of the buckle.
Figure 5:
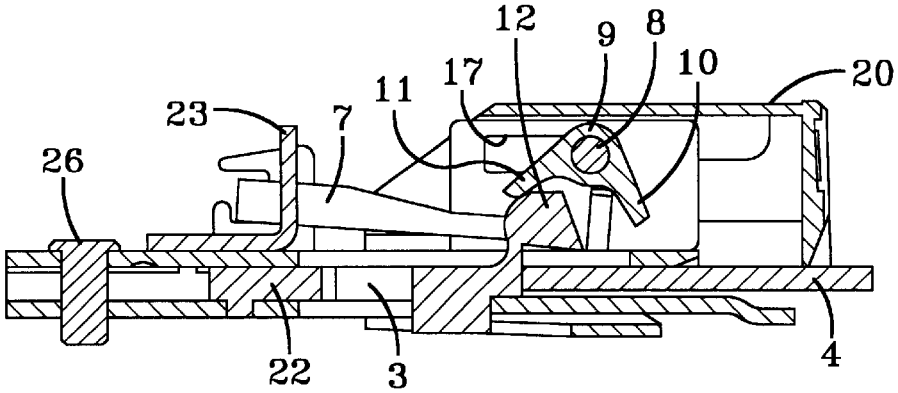
FIG. 5 is a sectional view along section line 5—5 in FIG. 4, wherein the ejector is located in its normal front position, in the locking position of the buckle.

In order to interlock the seat belt and the buckle, the tongue 4 is introduced in the guide channel 3, whereupon the ejector 5 is pushed against the force of the ejector spring 6 in a position shown in FIG. 5. In this locking position a locking element 7, with an engagement part 30, engages a locking recess 27 of the tongue 4. This locking position is shown in FIGS. 2 to 6.

In the locking position the locking element 7 is secured by a peg-like securing element 8. The securing element 8 is longitudinally guided in longitudinal slots 17 on the frame members 16. This longitudinal guiding is substantially parallel to the guide channel 3. A bias spring 14, which is supported by a spring support 23 fixed on the buckle frame, engages the securing element 8. The spring support 23 can also be formed on the lower plate 2. The bias spring 14, which is designed as a compression spring (helical compression spring), comprises a rod-like linear guiding means 21. The helical compression spring (bias spring 14) is wound around said guiding means. At its front end, the linear guiding means 21 comprises an engagement part 25, which engages the securing element 8. At its rear end the linear guiding means 21 is guided in a guide opening 24 of the spring support 23. This ensures that the bias spring 14 is kept in its linear shape with constant effective direction, in the respective positions of the securing element 8. Furthermore, the rod-like design of the linear guiding means 21 in this embodiment prevents breaking out, or kinking, of the bias spring 14 in all operative positions, thus always ensuring the desired securing and holding function of the securing element.

In the locking position the securing element 8 is in contact with securing surfaces 28 (FIG. 1) at the upper side of the locking element 7. The securing element 8 is held in the leading position in the guide slots 17 by means of the bias spring 14, in which position the securing element 8 is in contact with the ends of the guide slot 17. These ends of the guide slot form abutments 15 on the buckle frame. The width of the guide slot 17 is dimensioned slightly larger than the diameter of the securing element 8, such that the securing element is displaceably guided in the slots on the buckle frame. In the shown locking position, the securing element 8 is in contact with the abutments 15 at the front ends of the guide slots 17. This ensures that the locking element 7 is unable to move upwards, but is instead kept engaged with the locking recess 27 of the tongue 4.

Figure 6:
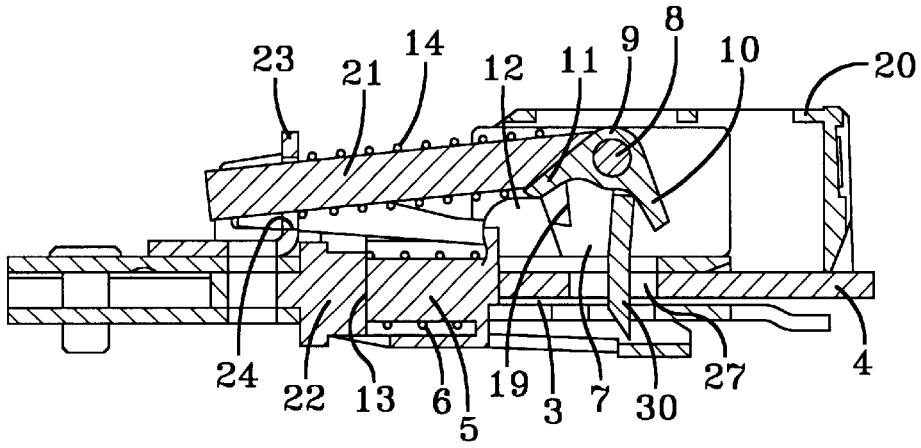
FIG. 6 is a sectional view along line 6—6 in FIG. 4, wherein the ejector is located in the rear position of the locking position of the buckle.

A blocking device 9 is pivotably mounted on the peg-like securing element 8. The blocking device is designed as an angle lever comprising first lever arms 10, which may be interconnected through a connecting link 31, and second lever arms 11. The lever arms 10, 11 are at an angle of about 90°. Upon introduction of the tongue 4 into the guide channel 3, the ejector 5 in FIGS. 4 to 6 is displaced from right to left, i.e. to the backward end of the guide channel 3. Thereupon, blocking device contours 12, formed on the ejector 5, engage the lever arms 11. The blocking device 9 is thus pivoted clockwise, whereby an actuating edge at the lower side of the connecting link 31 presses on the upper side e.g. an upper edge 29 of the locking element 7, which is pushed downwards out of the unlocking position into the locked position. The first lever arms 10 hereby act through the connecting link 26 on the locking element 7. Upon this movement the securing element 8, which is pressed by the bias spring 14 against holding surfaces 19 (FIGS. 1 and 6) on the locking element 7 in the unlocking position, is moved about an edge into the region of the securing surfaces 28. The securing element 8 in the guide slots 17 is thereby brought into the front position, wherein it is in contact with the abutments 15 and pressed by the bias spring 14.

In this blocking position the blocking device 9 rests with its second lever arms 11 on the blocking device contour 12 of the ejector 5, as shown in FIG. 5. Furthermore the blocking device 9 overlaps via its first lever arms 10 the upper edge 29, which extends transversely between the two securing surfaces 28 and over an engagement part 30, and is in contact with the locking element 7 in the region of the edge 29. A securing and fixing against any movement of the blocking device 9 on the buckle frame is hereby ensured. Because the securing element 8 is connected to the blocking device 9, a fixing of the securing element on the buckle frame is also ensured. A movement of the blocking device and of the securing element inside the guide slot 17 from the illustrated right position into the left position, i.e. in the unlocking direction, is rendered impossible.

In the blocking position the blocking device 9, with its two first lever arms 10, is in contact with the locking element 7, which is in the locking position. However, it is also possible to provide another stationary abutment on the buckle frame, in order to fix the blocking device 9 and the securing element 8 connected thereto, on the buckle frame by means of the blocking device contour 12 on the ejector 5.

The blocking device contour 12 on the ejector 5 is dimensioned such as to keep the blocking device 9 and the securing element 8 in a fixed blocking position or securing position, in the acceleration phase of the buckle as well as in the deceleration phase after the acceleration. The buckle is moved from right to left in FIGS. 4 to 6 upon retensioning of the buckle. As a result of inertia the ejector 5 and a push button 20 remain in the positions shown in FIGS. 4 and 5. The second lever arms 11 of the blocking device 9 rest on the rearward section of the blocking device contour 12, whereby the blocking device 9 is kept in said blocking position, shown in FIG. 5.

A deceleration occurs on completion of the retensioning movement, whereby the ejector 5 is moved out of its normal position, on the right in FIG. 5, to the left into the locking position of the buckle, until it impacts against the frame-fixed abutment 22. The length of the blocking device contour 12 is dimensioned such that it remains engaged with the second lever arms 11 of the blocking device 9, thus maintaining the blocking position of blocking device 9 and thereby the securing position of the securing element 8, as shown in FIG. 6. This ensures that the locking element 7, with its engagement part 30, is securely held in the locking recess 27 of the tongue 4.

Upon deceleration of the accelerated leftward directed movement, as for example on completion of the retensioning movement, the push button 20 is also moved to the left as a result of its inertia, whereby however a raising of the locking element 7 is prevented, since the blocking device 9 and the securing element are kept in the blocking or securing position respectively, as explained above. The reason for this is that the blocking device 9 with its second lever arms 11 is kept engaged with the blocking device contour 12 on the ejector 5, as shown in FIG. 6.

A deformable part 13 may be provided on the ejector 5. Upon impact of the ejector 5 on the frame-fixed abutment 22, this deformable part 13 is deformed, whereby energy is dissipated. On impact of the ejector 5 on the abutment 22, shock absorption is obtained. Bounce movements of the other functional parts of the buckle, which may result from the hard impact of the ejector on the abutment, are hereby prevented.

The buckle can be brought back in its unlocking position, by means of the push button 20. The push button, by means of an abutment or an interlocking fit provides for the displacement of the securing element 8 to the left in FIGS. 4 to 6, whereby the blocking device 9 with its second lever arms 11 detaches from the blocking device contour 12 and the securing element 8 is shifted into its final released position.

By lifting the locking element 7, effected by an outward rotation of a component in a drag bearing 18 of the locking element, its engagement part 30 is moved out of the locking recess 27 of the tongue 4. Through the effect of the ejector spring 6 and the ejector 5, the tongue 4 is ejected from the guide channel 3. The securing element 8 reaches holding surfaces 19 and is pressed by the bias spring 14 against these holding surfaces 19. The locking element is thereby kept in its locking position.

In the illustrated embodiment, the locking element 7 is pivotably mounted on the buckle frame, in the drag bearing 18, which can be designed in the same way as known from EP 0 777 984 A2. This allows the movement of the locking element between an unlocking position and a locking position.

Many changes and modifications in the above-described embodiments of the invention can, of course, be carried out without departing from the scope thereof. Accordingly, that scope is intended to be limited only by the scope of the appended claims.

We claim:

1. A seat belt buckle comprising:

a guide channel formed in a buckle frame, into which guide channel a tongue connected to the seat belt can be inserted;

an ejector guided in a guide channel, upon which ejector an ejector spring is acting in the ejection direction opposite to the insertion direction;

a locking element mounted on a buckle frame, which locking element can be moved out of an unlocking position into a locking position, in order to lock the tongue introduced into the guide channel;

a securing element which can be moved into a securing position, for holding the locking element in the locking position, and into a release position for releasing the locking element; and, a blocking device provided on the securing element, which blocking device is moved into a blocking position, when the locking element is in the locking position, wherein the securing element is firmly held in the securing position by the blocking device against a movement into the release position, and the blocking device is thereby held in the blocking position by the ejector.

2. The seat belt buckle according to claim 1, wherein the blocking device while in said blocking position is kept in abutment to a buckle part by the ejector, whereby a movement of the securing element into the release position is rendered impossible.

3. The seat belt buckle according to claim 2 wherein the blocking device is in contact with the locking element in the blocking position.

4. The seat belt buckle according to claim 2 wherein the ejector has a blocking device contour which engages the blocking device upon an accelerated movement in the insertion direction as well as upon a deceleration following this accelerated movement and holds said blocking device in the blocking position.

5. The seat belt buckle according to claim 2 wherein the blocking device is an angle lever comprising a first and a second lever arm pivotable about an axis formed on the securing element, whereby, in the blocking position, the first lever arm is in contact with the buckle part, in particular the locking element, and the second lever arm is in contact with the ejector, in particular the blocking device contour.

6. The seat belt buckle according to claim 2 wherein a deformable part is provided on the ejector, which part is deformable upon deceleration of the accelerated movement in the insertion direction of the buckle.

7. The seat belt buckle according to claim 2 wherein a bias spring engages the securing element, whereby the locking element is held in its unlocking position.

8. The seat belt buckle according to claim 2 wherein the securing element in said securing position is pressed by the bias spring against an abutment on the buckle frame.

9. The seat belt buckle according to claim 2 wherein a linear guiding means for the bias spring is provided.

10. The seat belt buckle according to claim 1 wherein the blocking device is in contact with the locking element in the blocking position.

11. The seat belt buckle according to claim 1 wherein the ejector has a blocking device contour which engages the blocking device upon an accelerated movement in the insertion direction as well as upon a deceleration following this accelerated movement and holds said blocking device in the blocking position.

12. The seat belt buckle according to claim 1 wherein the blocking device is an angle lever comprising a first and a second lever arm pivotable about an axis formed on the securing element, whereby, in the blocking position, the first lever arm is in contact with the buckle part, in particular the locking element, and the second lever arm is in contact with the ejector, in particular the blocking device contour.

13. The seat belt buckle according to claim 1 wherein a deformable part is provided on the ejector, which part is deformable upon deceleration of the accelerated movement in the insertion direction of the buckle.

14. The seat belt buckle according to claim 1 wherein a bias spring engages the securing element, whereby the locking element is held in its unlocking position.

15. The seat belt buckle according to claim 1 wherein the securing element in said securing position is pressed by the bias spring against an abutment on the buckle frame.

16. The seat belt buckle according to claim 1 wherein a linear guiding means for the bias spring is provided.

* * * * *